US011355277B2

(12) United States Patent
Ashizawa et al.

(10) Patent No.: US 11,355,277 B2
(45) Date of Patent: Jun. 7, 2022

(54) COIL COMPONENT

(71) Applicant: TDK CORPORATION, Tokyo (JP)

(72) Inventors: Syun Ashizawa, Tokyo (JP); Toshio Tomonari, Tokyo (JP); Masato Otsuka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 478 days.

(21) Appl. No.: 16/382,950

(22) Filed: Apr. 12, 2019

(65) Prior Publication Data

US 2019/0326046 A1 Oct. 24, 2019

(30) Foreign Application Priority Data

Apr. 19, 2018 (JP) ..... JP2018-080596

(51) Int. Cl.

| | |
|---|---|
| ***H01F 27/28*** | (2006.01) |
| ***H01F 27/26*** | (2006.01) |
| ***H01F 41/02*** | (2006.01) |
| ***H01F 27/29*** | (2006.01) |

(52) U.S. Cl.

CPC ..... *H01F 27/26* (2013.01); *H01F 27/29* (2013.01); *H01F 41/0206* (2013.01)

(58) Field of Classification Search

CPC ..... H01F 27/26; H01F 41/0206; H01F 27/29; H01F 27/2847; H01F 27/2852; H01F 3/14; H01F 27/38; H01F 27/306; H01F 27/292; H01F 17/04

See application file for complete search history.

(56) References Cited

U.S. PATENT DOCUMENTS

| | | | | |
|---|---|---|---|---|
| 7,525,406 | B1 * | 4/2009 | Cheng | H01F 17/043 336/232 |
| 8,970,339 | B2 * | 3/2015 | Catalano | H01F 27/306 336/212 |
| 2007/0252669 | A1 * | 11/2007 | Hansen | H01F 27/255 336/212 |
| 2008/0074225 | A1 * | 3/2008 | Hansen | H01F 41/02 336/83 |
| 2010/0176909 | A1 * | 7/2010 | Yasuda | H01F 3/12 336/233 |

(Continued)

FOREIGN PATENT DOCUMENTS

| | | | |
|---|---|---|---|
| JP | 2951324 | B1 | 9/1999 |
| JP | 2009016797 | A | 1/2009 |
| JP | 2009117676 | A | 5/2009 |

*Primary Examiner* — Mang Tin Bik Lian

(74) *Attorney, Agent, or Firm* — Young Law Firm, P.C.

(57) ABSTRACT

Disclosed herein is a coil component that includes a magnetic core having first and second through holes extending in a first direction and arranged in a second direction perpendicular to the first direction, and a conductive plate including first and second body parts inserted respectively through the first and second through holes. The magnetic core includes a middle leg part positioned between the first and second through holes, a first outer leg part positioned on an opposite side to the middle leg part across the first through hole, and a second outer leg part positioned on an opposite side to the middle leg part across the second through hole. Area of each of the first and second outer leg parts defined by the first and second directions is larger than that of the middle leg part.

19 Claims, 16 Drawing Sheets

(56) References Cited

U.S. PATENT DOCUMENTS

| | | | | |
|---|---|---|---|---|
| 2010/0237973 | A1* | 9/2010 | Cheng | H01F 41/04 336/83 |
| 2014/0266552 | A1* | 9/2014 | Silva | H01F 27/306 336/207 |
| 2014/0292459 | A1* | 10/2014 | Andres | H01F 38/28 336/105 |
| 2015/0332844 | A1* | 11/2015 | Xiong | H01F 27/24 323/271 |

* cited by examiner

COIL COMPONENT

BACKGROUND OF THE INVENTION

Field of the Invention

The present invention relates to a coil component and, more particularly, to a coil component capable of being used as a coupled inductor.

Description of Related Art

A coil component called "coupled inductor" may be used as a smoothing coil for a switching power supply such as a DC/DC converter. The coupled inductor has a pair of current paths magnetically coupled to each other. When current is made to flow in one current path, current also flows in the other current path by electromotive force. Thus, when the coupled inductor is used as a smoothing coil for a switching power supply, the peak of inrush current can be reduced.

For example, JP 2009-117676 A describes a coupled inductor having a configuration in which two conductive plates are inserted through a through hole formed in a magnetic core.

However, in the coupled inductor described in JP 2009-117676 A, two conductive plates are inserted through one through hole, so that the distance between the conductive plates is not fixed, resulting in an unstable coupling coefficient. To solve such a problem, Japanese Patent No. 2,951,324 proposes a method in which the two conductive plates are inserted, respectively, through two through holes formed in the magnetic core.

However, when the coil component described in Japanese Patent No. 2,951,324 is used as the coupled inductor, the following problem arises. That is, magnetic resistance is excessively low at so-called middle leg part, so that magnetic flux generated by current flowing in one conductive plate and magnetic flux generated by current flowing in the other conductive plate are mutually strengthened. As a result, a coupling coefficient becomes positive although a negative coupling coefficient is required in the coupling inductor.

SUMMARY

It is therefore an object of the present invention to provide a coil component capable of stably obtaining a desired coupling coefficient with a negative value.

A coil component according to the present invention includes a magnetic core having first and second through holes extending in a first direction and arranged in a second direction perpendicular to the first direction and a conductive plate including first and second body parts inserted respectively through the first and second through holes. The magnetic core includes a middle leg part positioned between the first and second through holes, a first outer leg part positioned on the side opposite to the middle leg part across the first through hole, and a second outer leg part positioned on the side opposite to the middle leg part across the second through hole. The area of each of the first and second outer leg parts defined by the first and second directions is larger than that of the middle leg part.

According to the present invention, the first and second body parts of the conductive plate are inserted respectively through the first and second through holes, thereby allowing the distance between the first and second body parts to be fixed. In addition, the area of the first and second outer leg parts is larger than that of the middle leg part, so that the magnetic flux components cancelling out each other prevails the magnetic flux components strengthening each other, with the result that a negative coupling coefficient required for a coupled inductor can be obtained.

In the present invention, the area of the plane of each of the first and second outer leg parts may be more than one time and five times or less the area of the plane of the middle leg part. This makes it possible to obtain a coupling coefficient of about −0.5 to about −0.8.

In the present invention, the area of the plane of each of the first and second outer leg parts may be more than one time and three times or less the area of the plane of the middle leg part. This makes it possible to obtain a coupling coefficient of about −0.5 to about −0.7.

In the present invention, the magnetic core may include a first core having first and second grooves in the upper surface thereof and a second core having a flat lower surface, and the upper surface of the first core and the lower surface of the second core may be bonded to each other to close the upper portions of the respective first and second grooves to thereby form the first and second through holes. In the upper surface of the first core, the plane of the middle leg part may be defined by a first upper surface part positioned between the first and second grooves, the plane of the first outer leg part may be defined by a second upper surface part positioned on the side opposite to the middle leg part across the first groove, and the plane of the second outer leg part may be defined by a third upper surface part positioned on the side opposite to the middle leg part across the second groove. This simplifies the shape of the second core, making it possible to reduce manufacturing cost.

In the present invention, the first to third upper surface parts may constitute the same plane. This simplifies the shape of the first core, making it possible to reduce manufacturing cost.

In the present invention, the first upper part may be lower in height than each of the second and third upper surface parts to make a magnetic gap formed in the middle leg part larger than a magnetic gap formed in each of the first and second outer leg parts. This can further reduce the amount of magnetic flux components that strengthen each other.

In the present invention, the conductive plate may include a metal element body having the first and second body parts and a terminal part and a connection part which are positioned outside the first and second through holes. The terminal part may include a first terminal part positioned on one end side of the first body part and a second terminal part positioned on one end side of the second body part. The connection part may connect the other end of the first body part and the other end of the second body part. By connecting the first terminal part to the positive electrode of a power supply circuit and by connecting the second terminal part to the negative electrode of the power supply circuit, the coil component according to the present invention can be used as a coupled inductor.

In the present invention, the terminal part may further include third and fourth terminal parts protruding from the connection part. This can reduce a difference in heat capacity among the first to fourth terminal parts.

In the present invention, the first to fourth terminal parts may each have a tapered shape in which the sectional area thereof is gradually reduced toward the tip end thereof. This facilitates formation of a solder fillet when the coil component according to the present invention is mounted on a circuit board, enhancing mounting strength and connection reliability.

In the present invention, the conductor plate may include a metal coating film formed on the surfaces of the respective first to fourth terminal parts and made of a material having a lower melting point than the metal element body and an insulating film formed on the surfaces of the respective first body part, second body part, and connection part without the metal coating film being interposed therebetween. With this configuration, even when a material having conductivity is used as the material of the magnetic core, it is possible to prevent the magnetic core and metal element body from being electrically short-circuited. In addition, the first body part, second body part, and connection part of the metal element body are covered with the insulating film without the metal coating film being interposed therebetween, so that it is possible to prevent the insulating film from being damaged or peeled off at reflow. Thus, there can be provided a coil component having high reliability.

As described above, the coil component according to the present invention can stably obtain a desired coupling coefficient having a negative value and can thus be suitably used as a coupled inductor.

BRIEF DESCRIPTION OF THE DRAWINGS

The above features and advantages of the present invention will be more apparent from the following description of certain preferred embodiments taken in conjunction with the accompanying drawings, in which:

FIG. 11A illustrates a current route passing through the middle leg part, and FIG. 11B illustrates a current route not passing through the middle leg part;

DETAILED DESCRIPTION OF THE EMBODIMENTS

Preferred embodiments of the present invention will be explained below in detail with reference to the accompanying drawings.

First Embodiment

Figure 1:
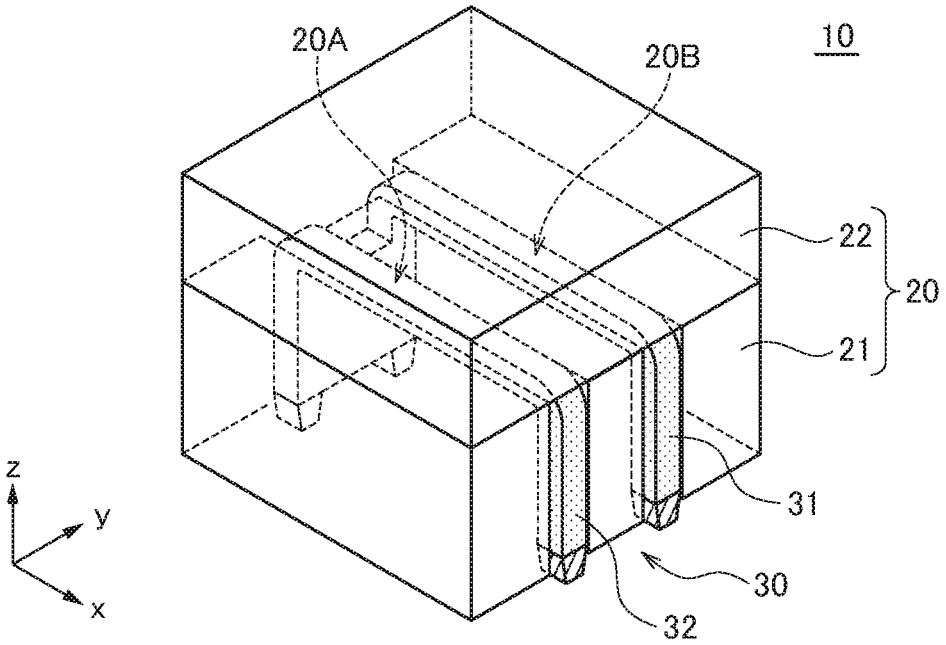
FIGS. 1 and 2 are perspective views for explaining the outer appearance of a coil component according to a first embodiment of the present invention, which illustrate the structure as viewed from the mutually opposite sides.
Figure 2:
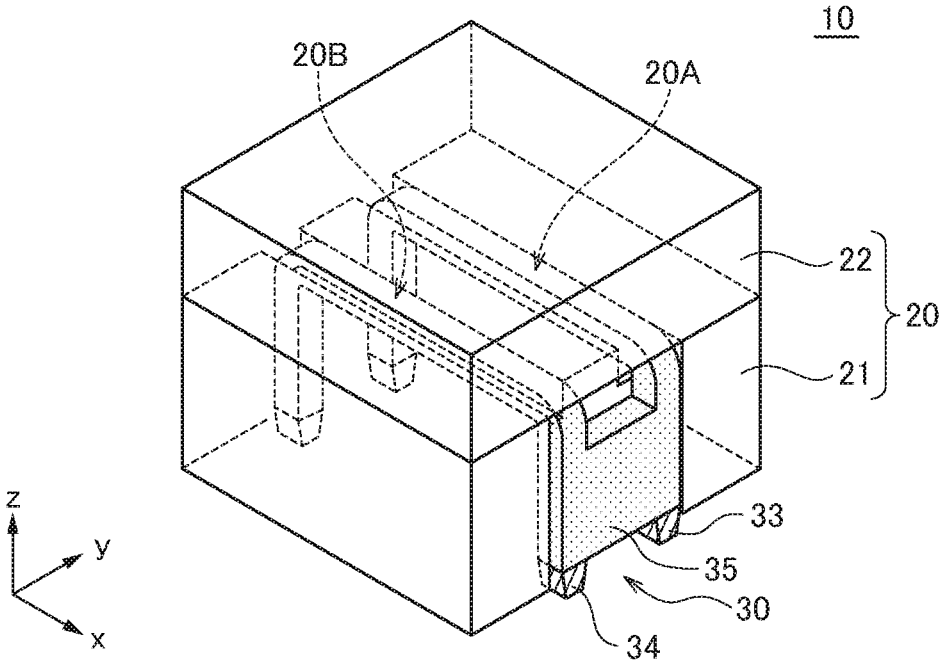
Figure 3:
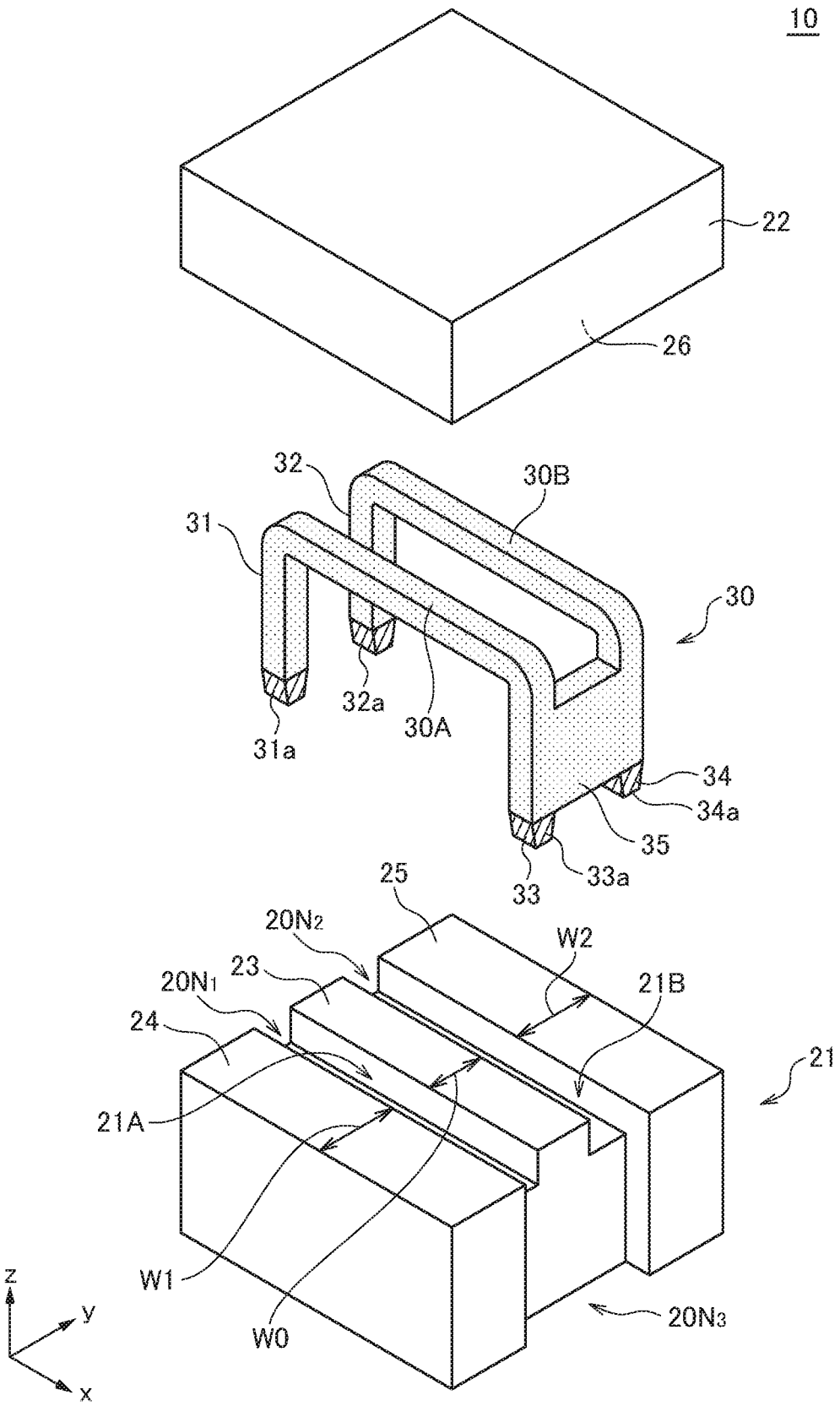
FIG. 3 is an exploded perspective view for explaining the structure of the coil component according to the first embodiment of the present invention.

FIGS. 1 and 2 are perspective views for explaining the outer appearance of a coil component 10 according to the first embodiment of the present invention, which illustrate the structure as viewed from the mutually opposite sides. FIG. 3 is an exploded perspective view for explaining the structure of the coil component 10.

The coil component 10 according to the present embodiment is a coil component capable of being used as a coupled inductor and is constituted of a magnetic core 20 and a conductive plate 30, as illustrated in FIGS. 1 to 3. The magnetic core 20 includes a first core 21 positioned on the lower side in the z-direction and a second core 22 positioned on the upper side in the z-direction and has a configuration in which the first and second cores 21 and 22 are bonded to each other. While there is no particular restriction on the material of the magnetic core 20, NiZn-based ferrite, MnZn-based ferrite, a metallic magnetic member, and the like can be used. In general, a magnetic material having conductivity such as MnZn-based ferrite has higher permeability than a magnetic material having a high insulating property such as NiZn-based ferrite and can thus obtain larger inductance. The magnetic core 20 may be obtained by machining a bulky magnetic material or may be a dust core obtained by press-molding magnetic powder. Further, the magnetic core 20 need not be constituted of a combination of the first and second cores 21 and 22, but may be constituted of a single member.

As illustrated in FIG. 3, two grooves 21A and 21B are formed in the xy plane constituting the upper surface of the first core 21 so as to extend in the x-direction and be arranged in the y-direction to thereby divide the upper surface of the first core 21 into three upper surface parts 23 to 25. The upper surface part 23 is positioned between the grooves 21A and 21B, and the upper surface parts 24 and 25 are each positioned outside the groove 21A or 21B. In the present embodiment, the upper surface parts 23 to 25 constitute the same plane. A width W0 of the upper surface part 23 in the y-direction is smaller than widths W1 and W2 of the respective upper surface parts 24 and 25 in the y-direction. Accordingly, the area of the upper surface part 23 is smaller than the area of each of the upper surface parts 24 and 25. The significance thereof will be described later.

The second core 22 has a flat-plate like shape and has no groove. Particularly, a lower surface 26 of the second core 22 is flat and bonded to at least one of the upper surface parts 23 to 25 of the first core 21 through a not-shown adhesive. The adhesive functions as a magnetic gap between the first and second cores 21 and 22, and leakage magnetic flux is generated from that portion. Thus, the saturation magnetic flux density of the coil component 10 can be adjusted according to the thickness of the adhesive. Further, when the first and second cores 21 and 22 are assembled to each other, the upper portions of the respective grooves 21A and 21B are closed by the second core 22, whereby first and second through holes 20A and 20B extending in the x-direction are formed.

The conductive plate 30 is inserted through the through holes 20A and 20B. As a result, a part of the magnetic core 20 that overlaps the first upper surface part 23 in a plan view (as viewed in the z-direction) constitutes a middle leg part, a part of the magnetic core 20 that overlaps the second upper surface part 24 in a plan view (as viewed in the z-direction) constitutes a first outer leg part, and a part of the magnetic core 20 that overlaps the third upper surface part 25 in a plan view (as viewed in the z-direction) constitutes a second outer leg part. The area of the middle leg part is defined by the area of the first upper surface part 23, the area of the first outer leg part is defined by the area of the second upper surface part 24, and the area of the second outer leg part is defined by the area of the third upper surface part 25.

Figure 4:
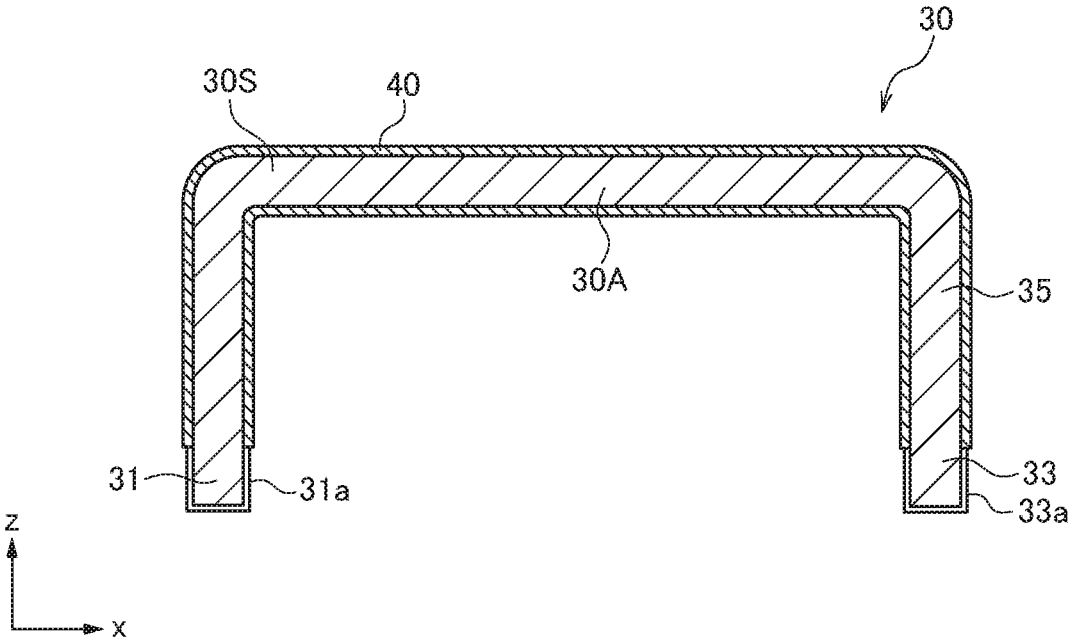
FIG. 4 is a cross-sectional view of a conductive plate.

As illustrated in FIG. 4, which is an xz cross-sectional view, the conductive plate 30 has a configuration in which metal coating films 31*a* to 34*a* and an insulating film 40 are formed on the surface of a high-conductive metal element body 30S made of Cu (copper). The metal element body 30S is obtained by bending a plate-like metal. plate having a substantially rectangular shape in cross section into a U-like shape and includes first and second body parts 30A and 30B, first to fourth terminal parts 31 to 34, and a connection part 35. The first and second body parts 30A and 30B extend in the x-direction and, as illustrated in FIGS. 1 and 2, are positioned inside the first and second through holes 20A and 20B, respectively.

The first terminal part 31 is a part obtained by bending, in the z-direction, one end of the first body part 30A in the x-direction and is connected to, e.g., the positive electrode of a power supply circuit in actual use. The second terminal part 32 is a part obtained by bending, in the z-direction, one end of the second body part 30B in the x-direction and is connected to, e.g., the negative electrode of a power supply circuit in actual use. The other ends of the respective body parts 30A and 30B in the x-direction are bent in the z-direction to constitute the third and fourth terminal parts 33 and 34, respectively. The third and fourth terminal parts 33 and 34 are short-circuited by the connection part 35. The third and fourth terminal parts 33 and 34 protrude in the z-direction from the connection part 35. With the above configuration, the coil component 10 according to the present embodiment has a four-terminal structure. One or both of the third and fourth terminal parts 33 and 34 are connected to, e.g., a load circuit. The boundary between the first and second body parts (30A, 30B) and the first to fourth terminal parts 31 to 34 and connection part 35 is defined by the bent portion at which the metal element body 30S is bent at about 90°. The tip end of each of the first to fourth terminal parts 31 to 34 preferably slightly protrudes from the bottom surface of the magnetic core 20.

The entire surface of each of the first body part 30A, second body part 30B, and connection part 35 is covered with the insulating film 40, while the surfaces of the first to fourth terminal parts 31 to 34 are partially covered with the first to fourth metal coating films 31*a* to 34*a*, respectively. The first to fourth metal coating films 31*a* to 34*a* are provided for ensuring solder wettability at mounting and are each made of a metal material, such as Sn or an alloy (NiSn alloy, etc.) including Sn, having a lower melting point than the metal element body. The film thickness of each of the first to fourth metal coating films 31*a* to 34*a* is preferably about 4 μm to about 20 μm and is preferably smaller than that of the insulating film 40. Each of the first to fourth metal coating films 31*a* to 34*a* may have a two-layer structure constituted of an underlying Ni plating having a thickness of about 1 μm to about 3 μm and an Sn plating having a thickness of about 4 μm to about 20 μm formed on the underlying Ni plating.

In the present embodiment, the first and second terminal parts 31 and 32 are covered with the metal coating films 31*a* and 32*a*, respectively, only around the tip ends thereof, and the remaining part thereof positioned at the root is covered with the insulating film 40. The insulating film 40 is formed directly on the surface of the metal element body 30S, and any other film, especially, the same metal material as the first to fourth metal coating films 31*a* to 34*a* is not interposed between the insulating film 40 and the metal element body 30S. Although not particularly limited, as the material of the insulating film 40, a resin material such as polyimide or epoxy resin is preferably used. The film thickness of the insulating film 40 is preferably about 5 μm to about 50 μm and, more preferably, about 5 μm to about 30 μm.

As illustrated in FIG. 3, in the magnetic core 20, three cut parts $20N_1$ to $20N_3$ are formed around the end portion of the first through hole 20A and that of the second through hole 20B. The first and second terminal parts 31 and 32 are housed in the cut parts $20N_1$ and $20N_2$, respectively, and the third and fourth terminal parts 33 and 34 and connection part 35 are housed in the cut part $20N_3$. Thus, the first to fourth terminal parts 31 to 34 and connection part 35 do not protrude in the x-direction, but are sandwiched at opposite sides in the y-direction thereof by the magnetic core 20. This allows increase in the volume of the magnetic core 20 as compared to a structure in which the first to fourth terminal parts 31 to 34 and connection part 35 protrude in the x-direction, without involving increase in the outer dimension.

Figure 5:
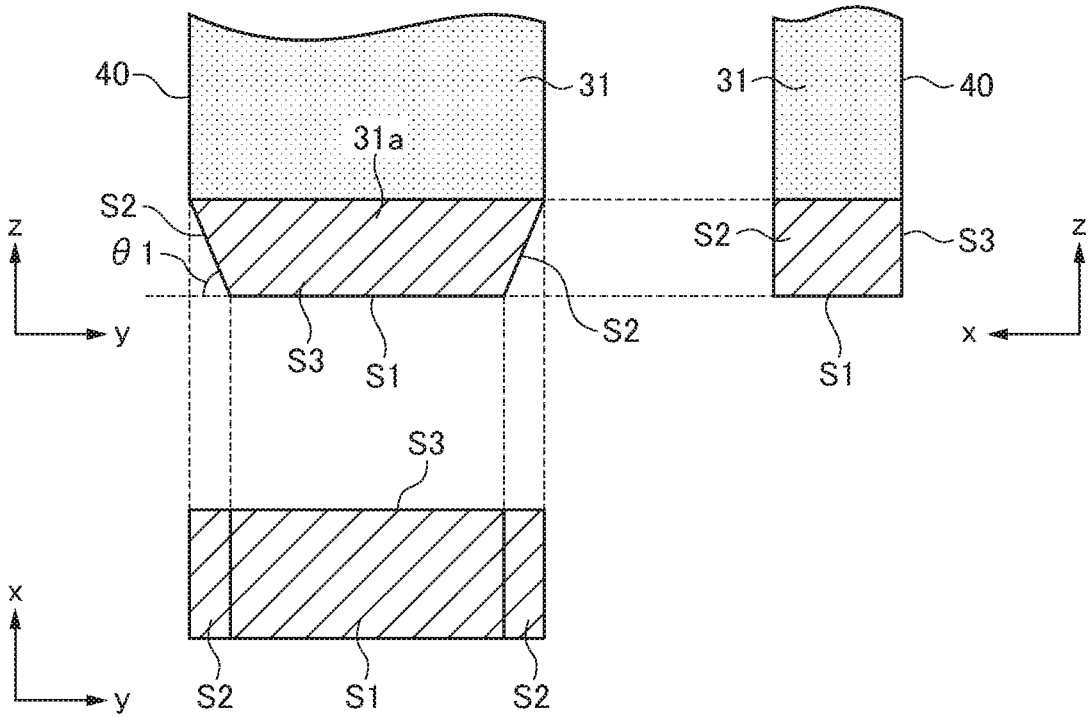
FIG. 5 is a view for more specifically explaining the shape of a first terminal part.

FIG. 5 is a view for more specifically explaining the shape of the first terminal part 31.

As illustrated in FIG. 5, the first terminal part 31 has a tapered shape in which the sectional area thereof is gradually reduced toward the tip end thereof. That is, the first terminal part 31 has a tip surface S1 constituting the xy plane, a pair of tapered surfaces 32 inclined at an angle θ1 relative to the tip surface S1, and a pair of side surfaces S3 constituting the yz plane, and the surfaces S1 to S3 are covered with the metal coating film 31*a*. In the remaining part of the first terminal part 31, the surface of the metal element body 30S is covered with the insulating film 40 without the metal coating film 31*a* being interposed therebetween. While the value of the angle θ1 of the tapered surface S2 is not particularly restricted, it is preferably in the range of 60° to 80°.

Although not illustrated, the terminal parts 32 to 34 have the same configuration. That is, the terminal parts 32 to 34 each have the tip surface S1, tapered surfaces S2, and side surfaces S3, and the surfaces S1 to S3 are covered with the metal coating film (32*a* to 34*a*). As described above, in the remaining part of the conductive plate 30, including the first body part 30A, second body part 30B, and connection part 35, other than the terminal parts 31 to 34, the surface of the metal element body 30S is covered with the insulating film 40 without the metal coating film (31*a* to 34*a*) being interposed therebetween.

Figure 6:
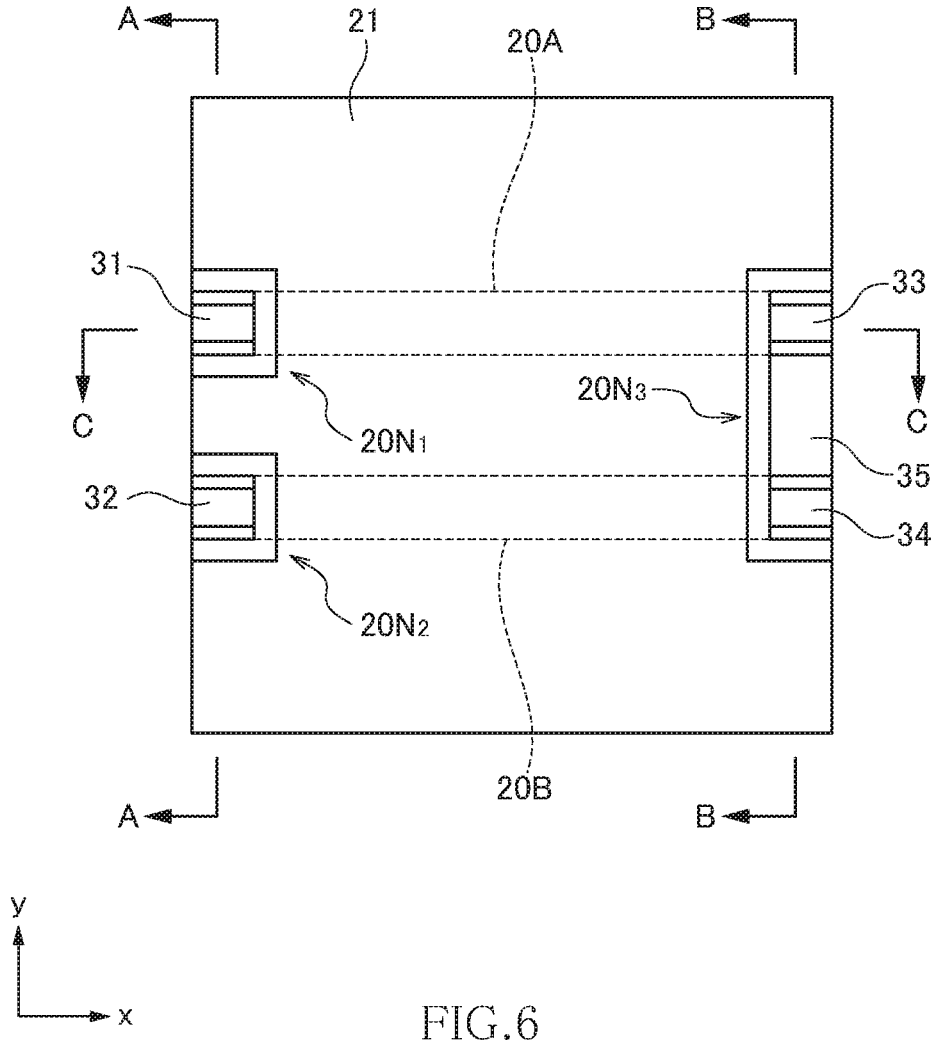
FIG. 6 is a plan view illustrating the bottom surface of the coil component according to the first embodiment of the present invention.
Figure 7A:
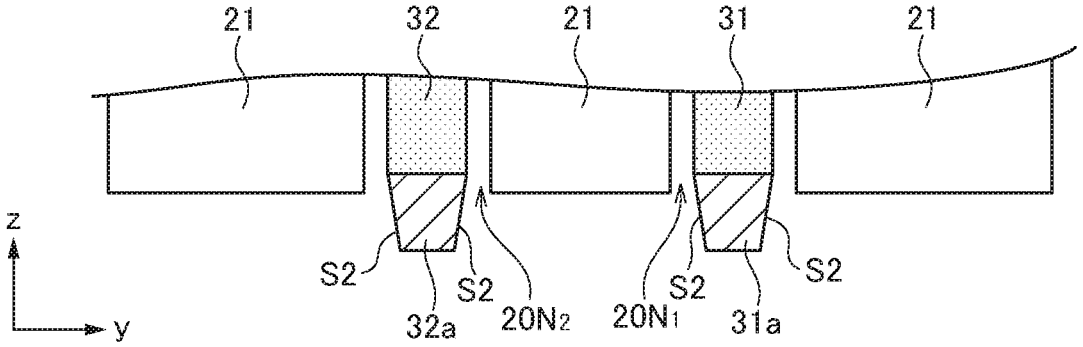
FIGS. 7A to 7C are partial cross-sectional views taken along lines A-A, B-B, and C-C in FIG. 6, respectively.
Figure 7B:
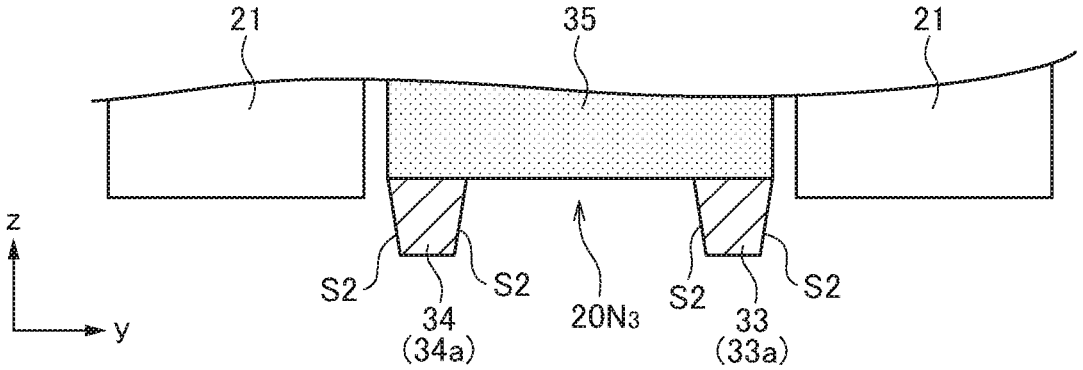
Figure 7C:
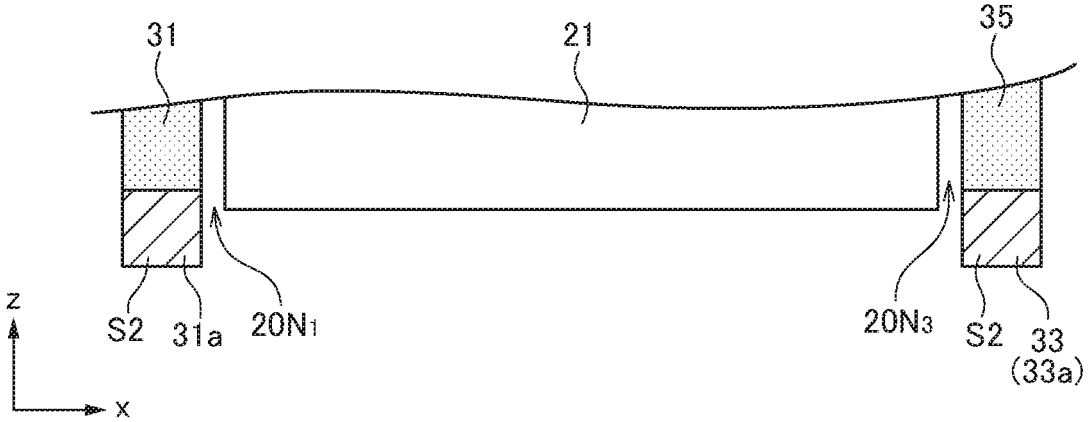

FIG. 6 is a plan view illustrating the bottom surface of the coil component 10, and FIGS. 7A to 7C are partial cross-sectional views taken along lines A-A, B-B, and C-C in FIG. 6, respectively.

As illustrated in FIGS. 6 and 7A to 7C, the three cut parts $20N_1$ to $20N_3$ are formed in the magnetic core 20. The first terminal part 31 is housed in the cut part $20N_1$, the second terminal part 32 is housed in the cut part $20N_2$, and the third and fourth terminal parts 33 and 34 and connection part 35 are housed in the cut part $20N_3$.

Figure 8:
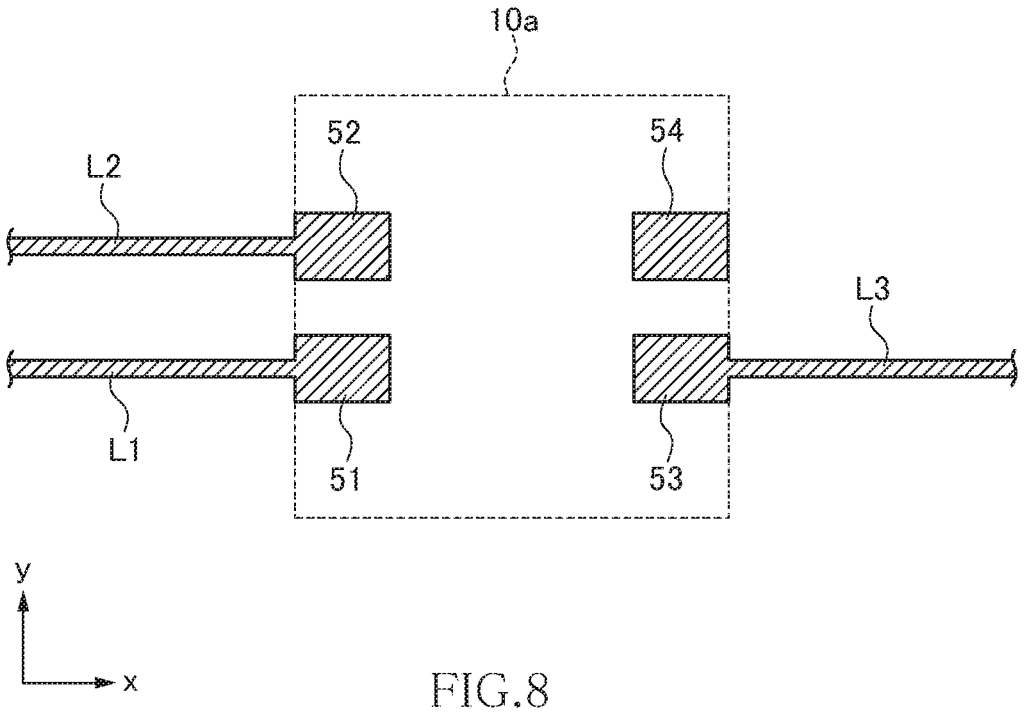
FIG. 8 is a plan view illustrating the pattern shapes of respective conductive patterns on a printed circuit board on which the coil component is mounted.

FIG. 8 is a plan view illustrating the pattern shapes of respective conductive patterns on a printed circuit board on which the coil component 10 is mounted.

Figure 9:
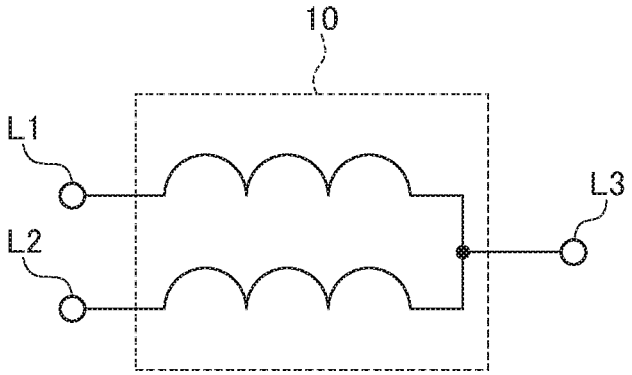
FIG. 9 is an equivalent circuit of the coil component.

The reference numeral 10*a* in FIG. 8 denotes the mounting area of the coil component 10, on which four land patterns 51 to 54 are formed. The land patterns 51 to 54 are connected to the terminal parts 31 to 34, respectively. The land patterns 51 to 53 are connected with wiring patterns L1 to L3, respectively, while the land pattern 54 is not connected with a wiring pattern and exclusively used for mechanical fixing. However, the land pattern 54 may be connected with the wiring pattern L3. With the above configuration, as illustrated in the circuit diagram of FIG. 9, when the coil component 10 is mounted on the circuit board, inductances are inserted between the wiring patterns L1 and L3 and between the wiring patterns L2 and L3, respectively, and these inductances are coupled to each other. As described above, the coil component 10 can be used as a coupled inductor.

Figure 10A:
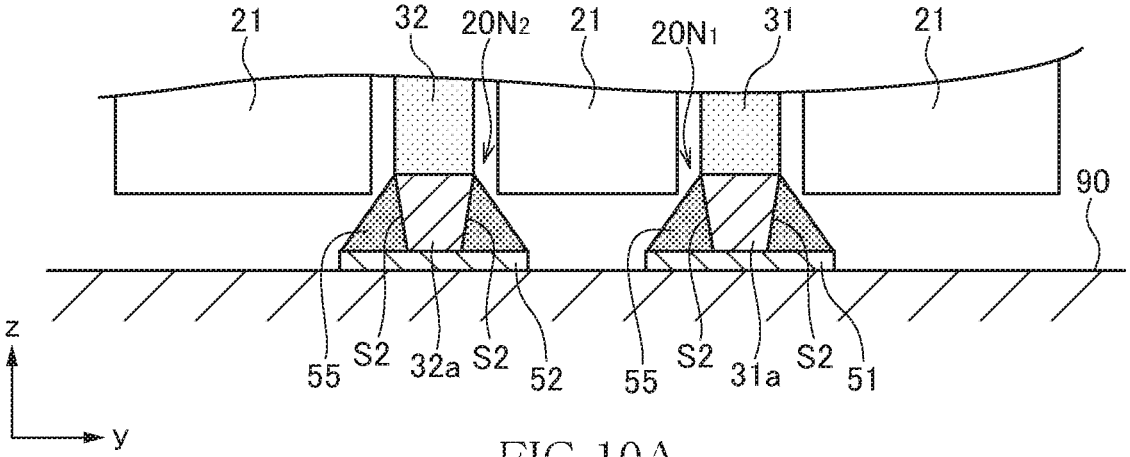
FIGS. 10A to 10C are views each explaining a state where the coil component is mounted on a circuit board by soldering.
Figure 10B:
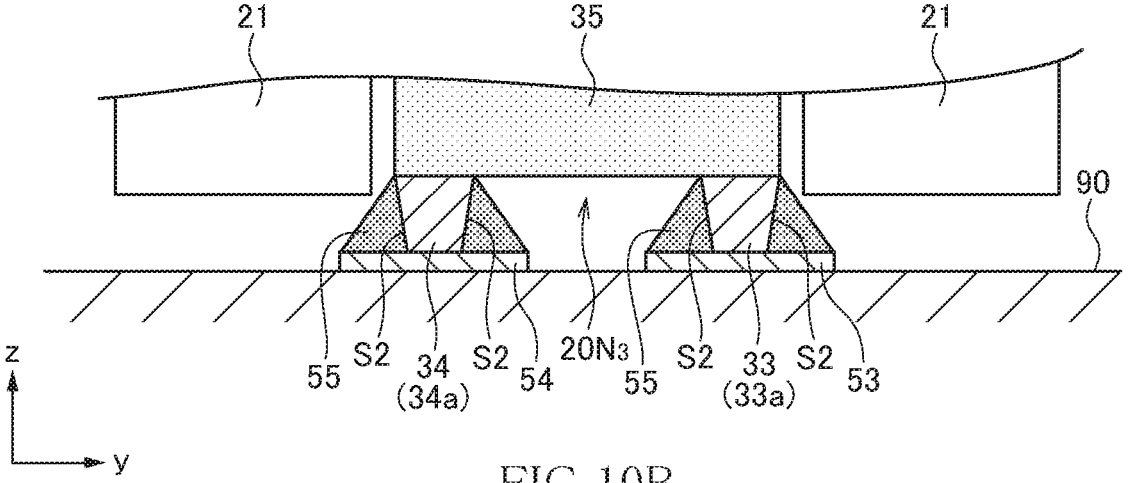
Figure 10C:
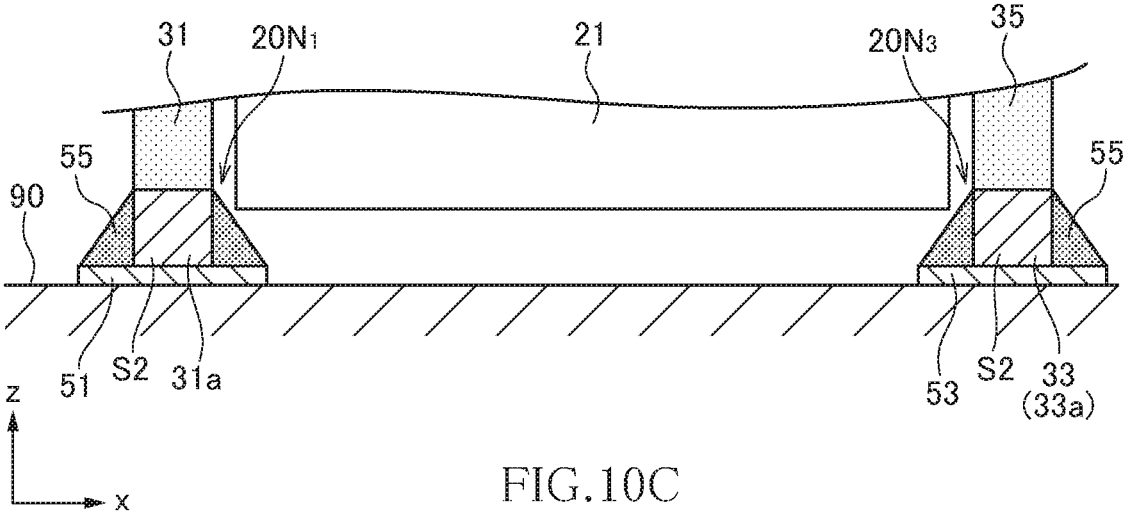

FIGS. 10A to 10C are views each explaining a state where the coil component 10 is mounted on a circuit board 90 by soldering. FIGS. 10A to 10C correspond to the partial cross-sectional views of FIGS. 7A to 7C, respectively.

As illustrated in FIGS. 10A to 10C, when the coil component 10 is mounted on the circuit board 90 such that the terminal parts 31 to 34 and their corresponding land patterns 51 to 54 overlap each other, followed by soldering, a solder 55 forms a fillet that covers the tapered surfaces S2 and side surfaces S3. The tapered surfaces S2 of each of the terminal parts 31 to 34 are not vertical to the circuit board 90, but inclined at the angle θ1 smaller than 90 degrees, thereby facilitating the formation of the fillet as compared to a case where the tapered surfaces S2 are vertical to the circuit board 90.

Figure 11A:
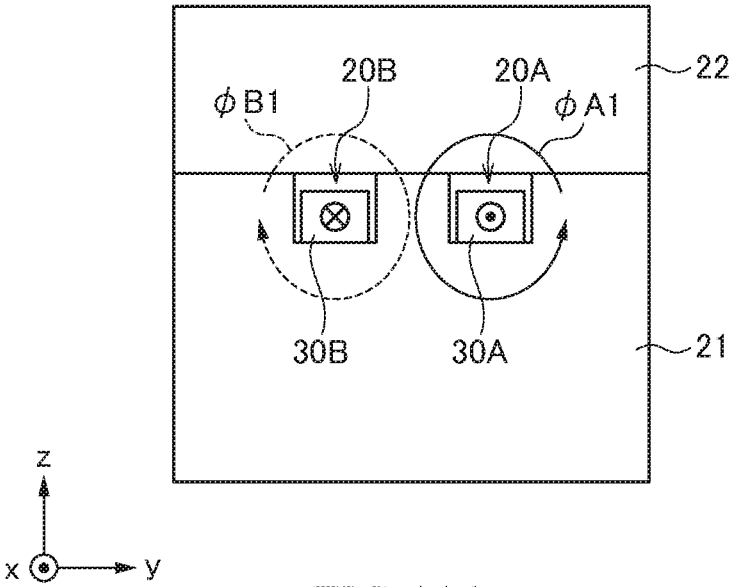
FIGS. 11A and 11B are views each explaining magnetic flux generated when currents in opposite directions are made to flow in the body parts 30A and 30B, respectively, where
Figure 11B:
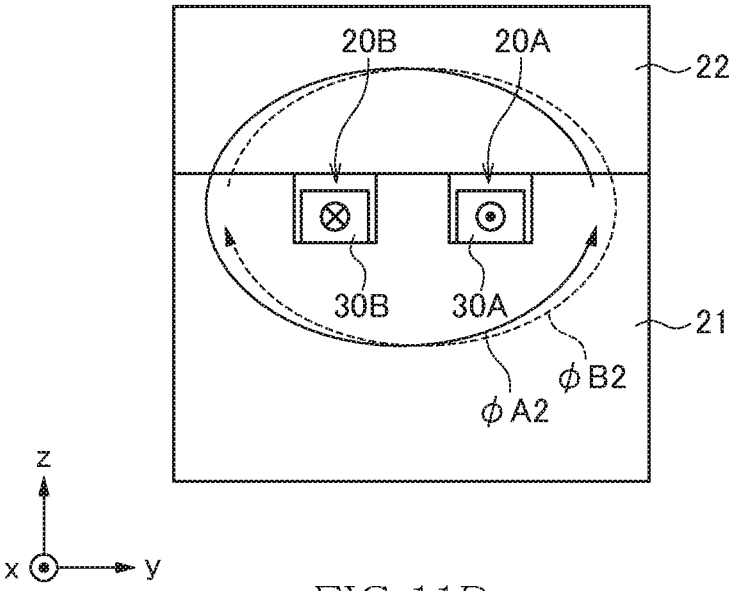

FIGS. 11A and 11B are views each explaining magnetic flux generated when currents in opposite directions are made to flow in the body parts 30A and 30B, respectively. FIG. 11A illustrates a current route passing through the middle leg part, and FIG. 11B illustrates a current route not passing through the middle leg part.

In the example of FIGS. 11A and 11B, counterclockwise (left-handed) magnetic fluxes ϕA1 and ϕA2 are generated in the magnetic core 20 by current flowing through the body part 30A, and clockwise (right-handed) magnetic fluxes ϕB1 and ϕB2 are generated in the magnetic core 20 by current flowing through the body part 30B. In the example of FIGS. 11A and 11B, the magnetic fluxes ϕA1 and ϕA2 generated by the current flowing through the body part 30A are each denoted by a continuous line, and magnetic fluxes ϕB1 and ϕB2 generated by the current flowing through the body part 30B are each denoted by a dashed line.

As illustrated in FIG. 11A, the magnetic fluxes ϕA1 and ϕB1 that pass through the middle leg part strengthen each other at the middle leg part. That is, this magnetic flux route increases a coupling coefficient to the positive side. On the other hand, as illustrated in FIG. 11B, the magnetic fluxes ϕA2 and ϕB2 that do not pass through the middle leg part cancel each other. That is, this magnetic flux route increases a coupling coefficient to the negative side. Thus, by controlling the amount of the magnetic fluxes ϕA1 and ϕB1 and that of the magnetic fluxes ϕA2 and ϕB2, a desired coupling coefficient can be obtained.

Figure 12:
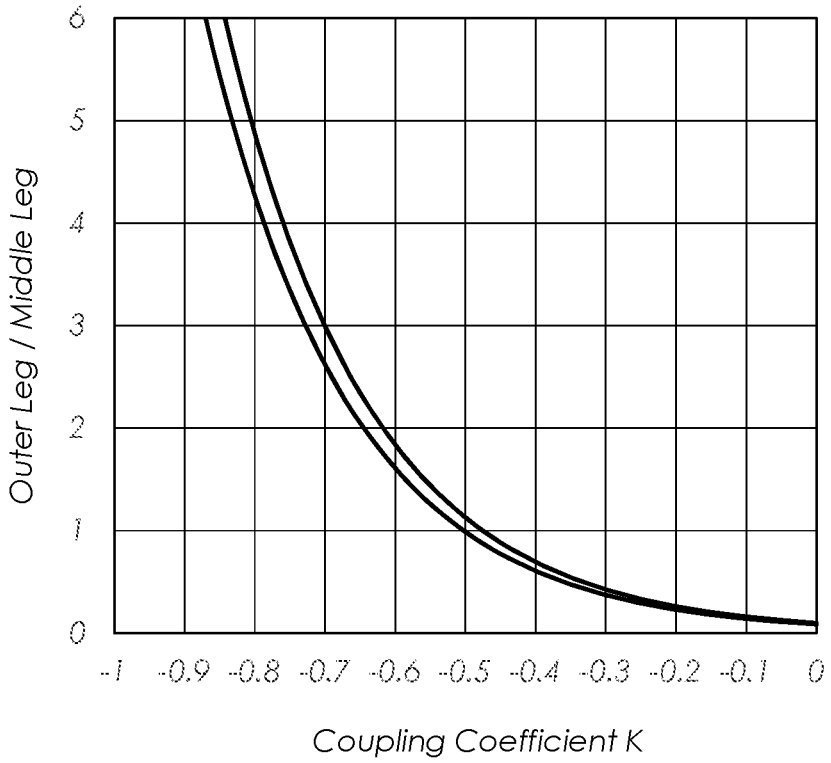
FIG. 12 is a graph illustrating a simulation result concerning the relationship between the ratio (outer leg/middle leg) between the area of the middle leg part and the area of the first or second outer leg part and a coupling coefficient.

FIG. 12 is a graph illustrating a simulation result concerning the relationship between the ratio (outer leg/middle leg) between the area of the middle leg part and the area of the first or second outer leg part and a coupling coefficient. The simulation conditions include: using MnZn-based ferrite as the material of the magnetic core 20; setting the length in the x-direction to 4 mm, width in the y-direction to 4 mm, and height in the z-direction to 4 mm; and setting inductance to 100 nH or 180 nH. The area of the first outer leg part and that of the second outer leg part are set equal to each other, and "area of the outer leg part" refers to the area of one of the first and second outer leg parts.

The graph of FIG. 12 reveals that the larger the value of the outer leg/middle leg is, that is, the smaller the area of the middle leg part is as compared with the area of the outer leg part, the more the coupling coefficient increases to the negative side. Accordingly, in order to increase the coupling coefficient to the negative side so that the coil component 10 is used as a coupling inductor, the value of the outer leg/middle leg may be set to a larger value. Specifically, depending on the design value of inductance, when the value of the outer leg/middle leg exceeds 1, the coupling coefficient becomes equal to or smaller than about −0.5, with the result that it is possible to obtain a coupling coefficient suitable for a coupled inductor. Particularly, when the value of the outer leg/middle leg is about 3, the coupling coefficient becomes about −0.7, and when the value of the outer leg/middle leg is about 5, the coupling coefficient becomes about −0.8. Accordingly, in order to obtain a coupling coefficient of about −0.5 to about −0.8, the outer leg/middle leg may be set to a value larger than 1 and 5 or smaller, and in order to obtain a coupling coefficient of about −0.5 to about −0.7, the outer leg/middle leg may be set to a value larger than 1 and 3 or smaller.

Further, in the coil component 10 according to the present embodiment, the area of the outer leg part is larger than the middle leg part, so that it is possible to obtain a negative coupling coefficient, e.g., a coupling coefficient of −0.5 or smaller. This allows a coil component suitably used as a coupled inductor to be provided. In addition, in the coil component 10 according to the present embodiment, the first and second body parts 30A and 30B are integrated with each other through the connection part 35, and the first and second body parts 30A and 30B are independently inserted through the first and second through holes 20A and 20B, respectively, preventing deviation in the positional relationship between the first and second body parts 30A and 30B. This makes it possible to stably obtain a coupling coefficient as designed.

In addition, in the present embodiment, the upper surface parts 23 to 25 of the first core 21 constitute the same plane, and the lower surface 26 of the second core 22 is flat, thereby facilitating the fabrication of the first and second cores 21 and 22, which in turn can reduce manufacturing cost.

Further, in the present embodiment, of the entire surface of the metal element body 30S, the surfaces of the respective first body part 30A, second body part 30B, and connection part 35 are covered with the insulating film 40, so that even when a magnetic material having conductivity, such as MnZn-based ferrite, is used as the material of the magnetic core 20, electrical short circuit between the metal element body 30S and the magnetic core 20 can be prevented. In addition, in the present embodiment, the insulating film 40 is directly formed on the surface of the metal element body 30S, and a metal coating film made of the same metal material as the first to fourth metal coating films 31*a* to 34*a* is not interposed between the insulating film 40 and the metal element body 30S. This prevents the insulating film 40 from being damaged or peeled off due to heat at reflow, making it possible to enhance product reliability.

Further, although the coil component 10 according to the present embodiment has a three-terminal configuration in terms of electricity, it has the four terminal parts 31 to 34, so that a difference in heat capacity among the terminal parts 31 to 34 is reduced. As a result, melting of the solder 55 at solder reflow occurs substantially simultaneously in the terminal parts 31 to 34, making it possible to prevent unintentional rotation of components due to a difference in melting timing.

The following describes a manufacturing method for the coil component 10 according to the present embodiment.

FIGS. 13 to 19 are process views for explaining the manufacturing method for the coil component 10 according to the present embodiment.

Figure 13:
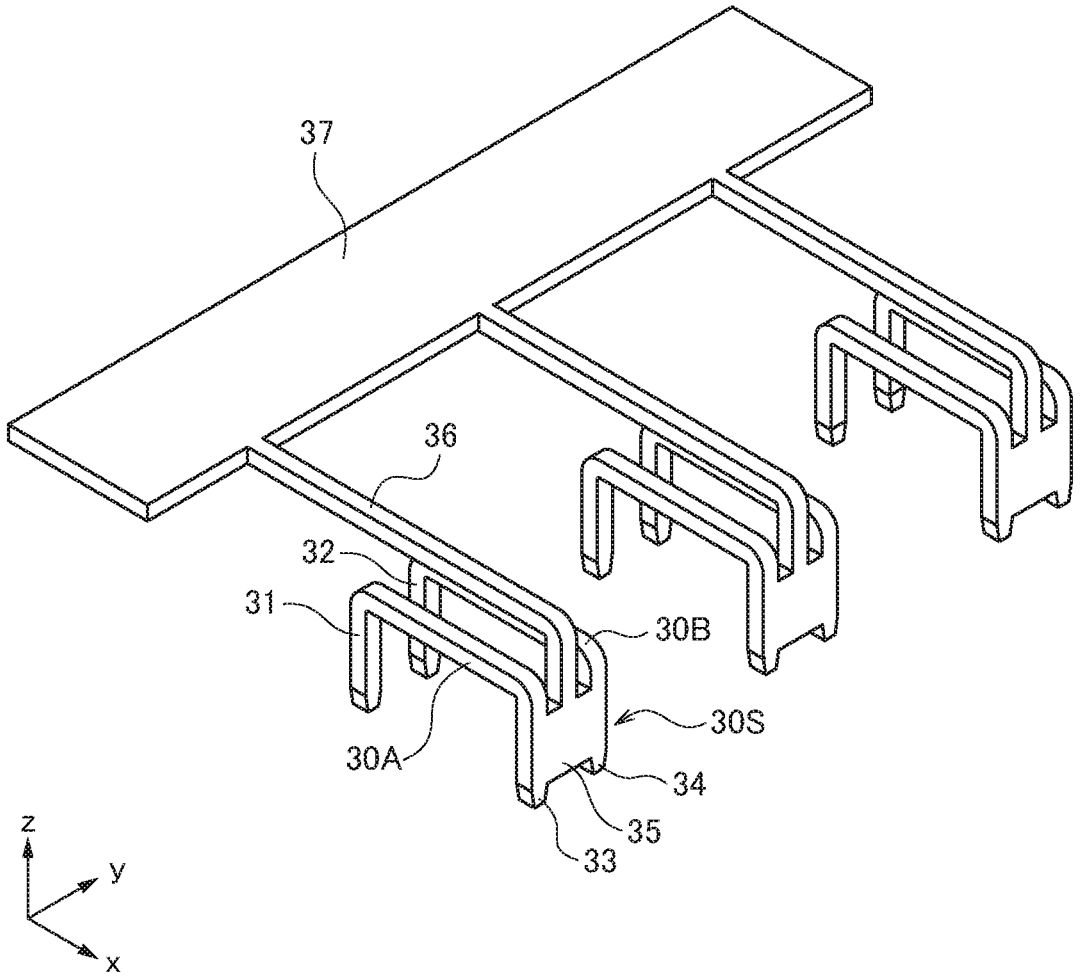
FIGS. 13 to 19 are process views for explaining the manufacturing method for the coil component according to the first embodiment of the present invention.

First, as illustrated in FIG. 13, a metal plate made of Cu (copper) punched into a predetermined planar shape is prepared, followed by bending at predetermined positions, to thereby form the metal element body 30S. As described above, the metal element body 30S includes the first body part 30A, second body part 30B, first to fourth terminal parts 31 to 34, and connection part 35. In this stage, a support part 36 is connected to substantially the center portion of the connection part 35 in the y-direction and, as illustrated, the plurality of support parts 36 are connected to a frame part 37. The support part 36 is removed in the subsequent process, so that a cut or the like is preferably formed at the boundary between the connection part 35 and the support part 36.

Figure 14:
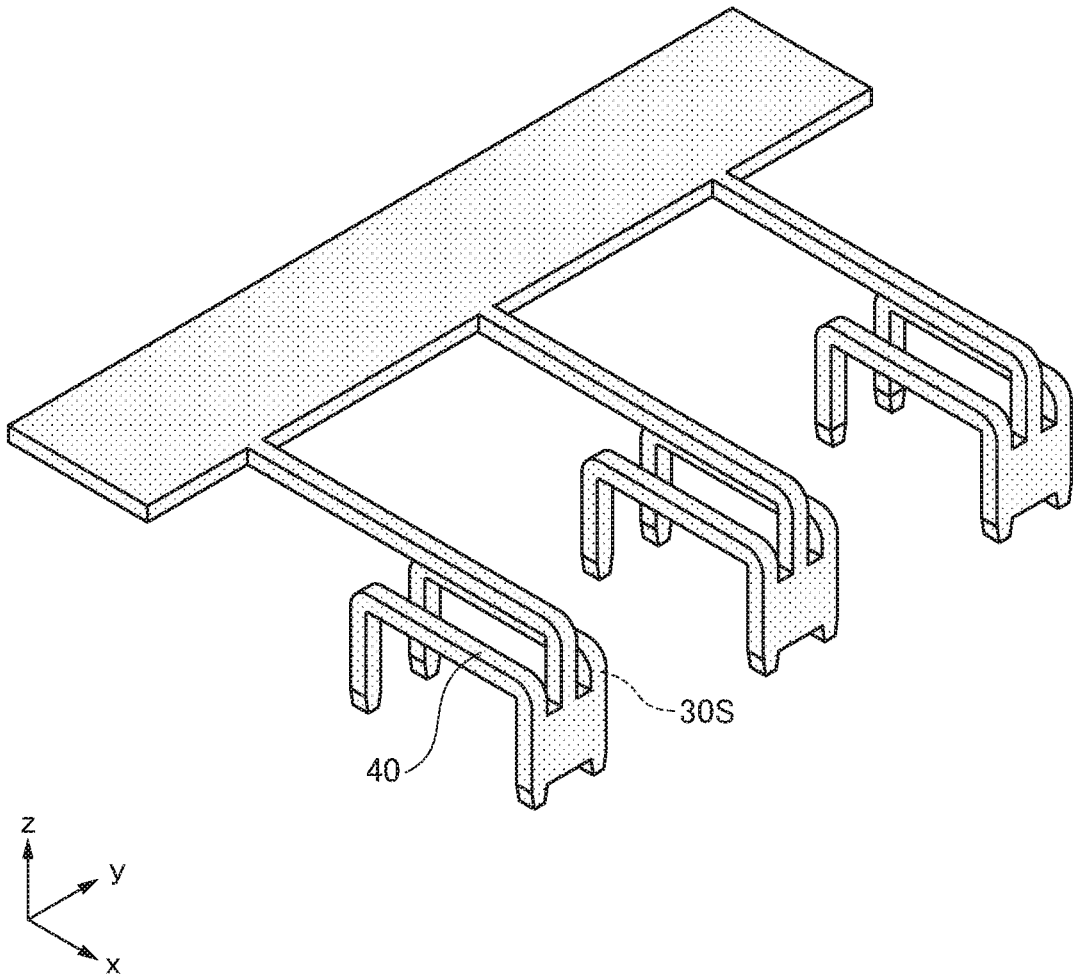

Subsequently, as illustrated in FIG. 14, the insulating film 40 of a resin material such as polyimide or epoxy resin is formed on the entire surface of the metal element body 30S by an electrodeposition method. Using the electrodeposition method allows uniform formation of the insulating film 40 on the entire surface of the metal element body 30S including corner portions. On the other hand, when a fluorine-based insulating film is formed by a spraying method or a dipping method, the uniformity of the film thickness cannot be sufficiently ensured. Particularly, the film thickness becomes very small at the corner portions and, in some cases, the metal element body 30S may be exposed there. In the present embodiment, the insulating film 40 is formed by the electrodeposition method, thus allowing uniform formation of the insulating film 40 on the entire surface of the metal element body 30S including corner portions.

Figure 15:
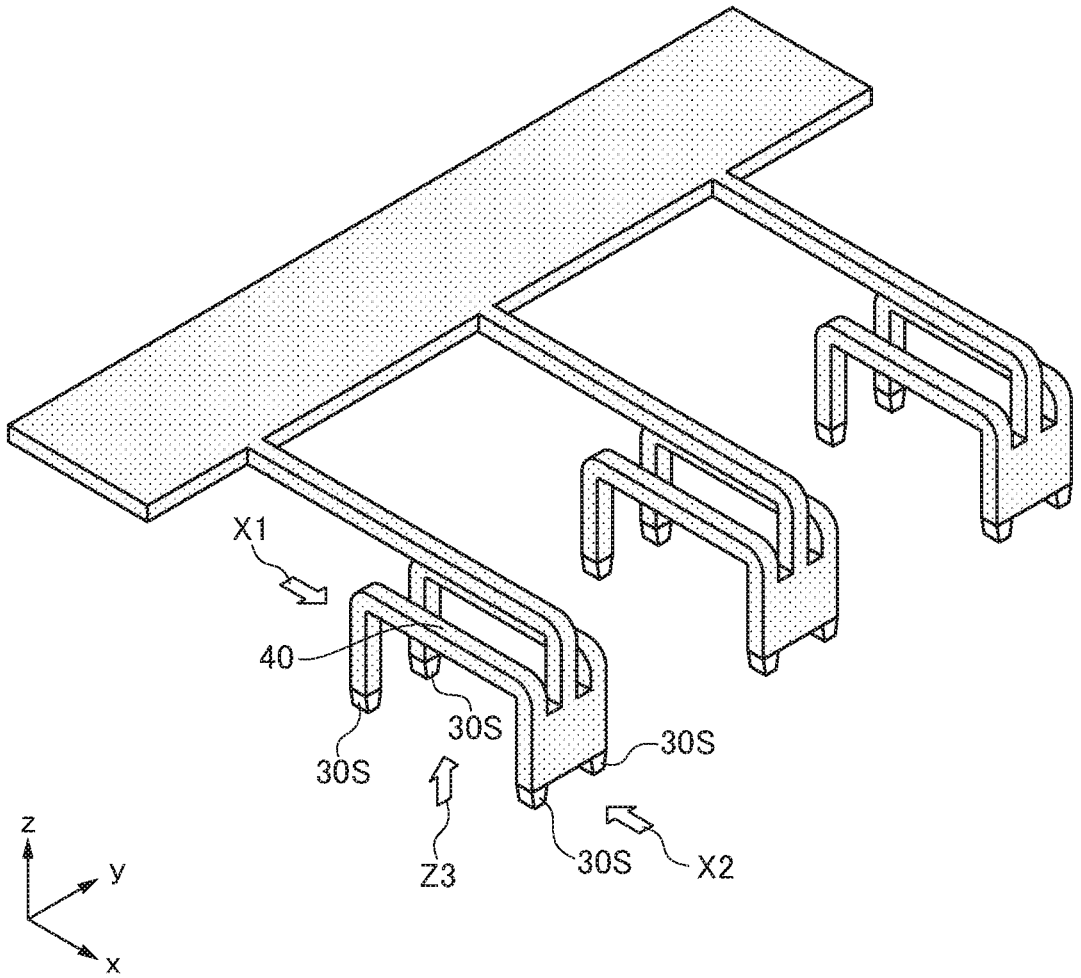

Subsequently, as illustrated in FIG. 15, the insulating film 40 around the tip end of each of the first to fourth terminal parts 31 to 34 is selectively removed. While there is no particular restriction on the method of removing the insulating film 40, the insulating film 40 can be physically removed through abrasion by laser beam irradiation or through filing. Particularly, using laser beam allows highly accurate removal of the insulating film 40. When the insulating film 40 is removed using laser beam, the laser beam is irradiated at least in the directions X1, X2, and Z3 as illustrated in FIG. 15. The laser beam irradiation in the direction X1 removes the insulating film 40 formed on one side surface S3 of each of the terminal parts 31 to 34. The laser beam irradiation in the direction X2 removes the insulating film 40 formed on the other side surface S3 of each of the terminal parts 31 to 34. The laser beam irradiation in the direction Z3 simultaneously removes the insulating film 40 formed on the tip surface S1 and tapered surfaces S2 of each of the terminal parts 31 to 34. This is because the tapered surfaces S2 are exposed as viewed in the z-direction, as illustrated in FIG. 5. As a result, the insulating film 40 formed on the tip surface S1, tapered surfaces S2, and both side surfaces S3 of each of the terminal parts 31 to 34 is removed, with the result that the metal element body 30S is exposed again at the removal portions of the insulating film 40.

Figure 16:
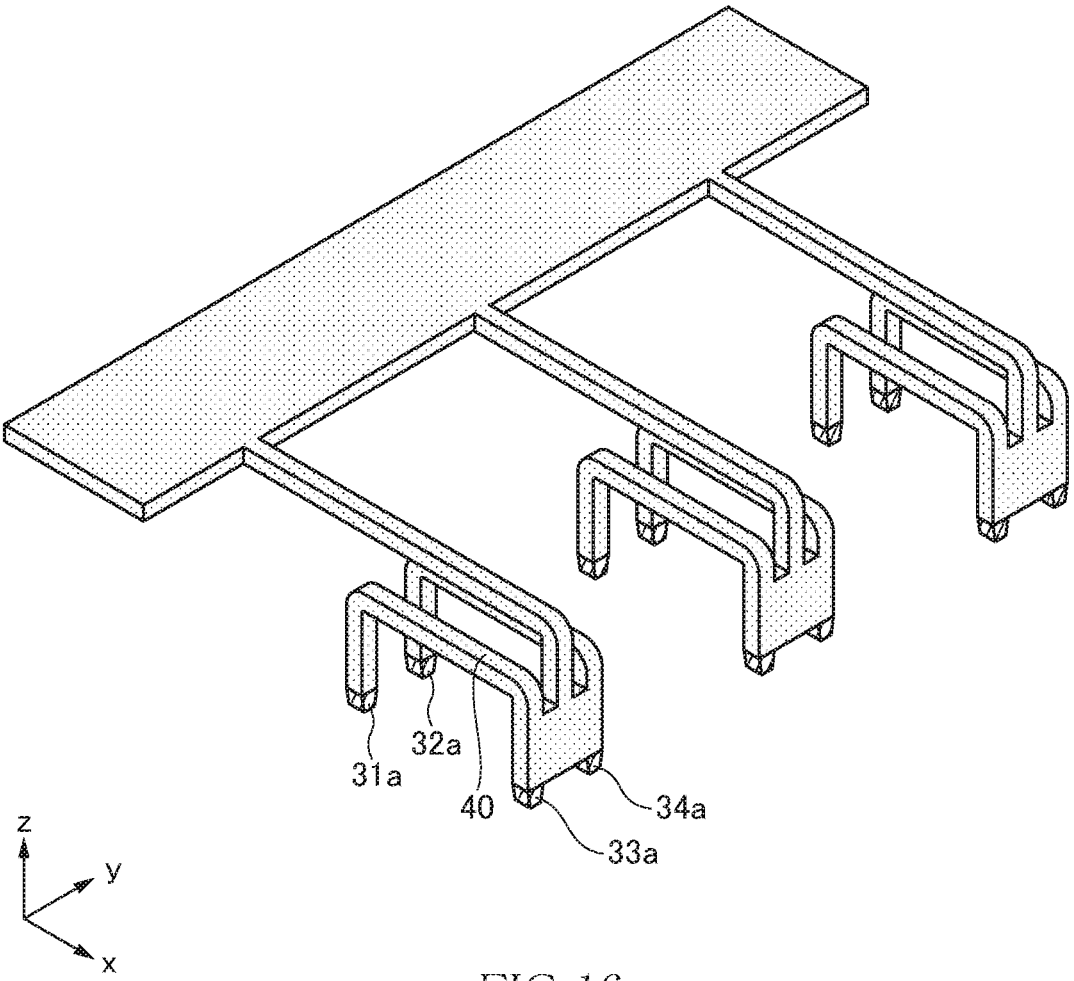

Subsequently, as illustrated in FIG. 16, the metal coating films 31*a* to 34*a* are formed by plating on the surfaces of the respective first to fourth terminal parts 31 to 34. The surfaces of the respective first to fourth terminal parts 31 to 34 are exposed by the removal of the insulating film 40. In this process, the insulating film 40 functions as a plating mask, allowing the metal coating films 31*a* to 34*a* to be selectively formed only on the exposed surfaces of the respective first to fourth terminal parts 31 to 34. The exposed surface of each of the first to fourth terminal parts 31 to 34 refers to the tip surface S1, tapered surfaces S2, and both side surfaces S3. The insulating film 40 functioning as the plating mask is formed by the electrodeposition method, and thus the entire surface including the corner portions is uniformly covered with the insulating film 40, thereby preventing the metal coating film from being formed by plating on an unintended portion. On the other hand, as described above, when a fluorine-based insulating film is formed by a spraying method or a dipping method, the metal element body 30S may be exposed at the corner portions. In this case, the metal coating film is undesirably formed on the metal element body 30S exposed at the corner portions. To prevent this, a metal coating film of tin is formed beforehand on the entire surface of the metal element body 30S, followed by formation of the insulating film 40 on necessary portions (body parts 30A, 30B, and connection part 35); in this case, however, the metal coating film is interposed between the metal element body 30S and the insulating film 40. Nonetheless, the above problem does not occur in the present embodiment, since the insulating film 40 is formed by the electrodeposition method before plating is applied to the exposed surfaces not covered with the insulating film 40.

Figure 17:
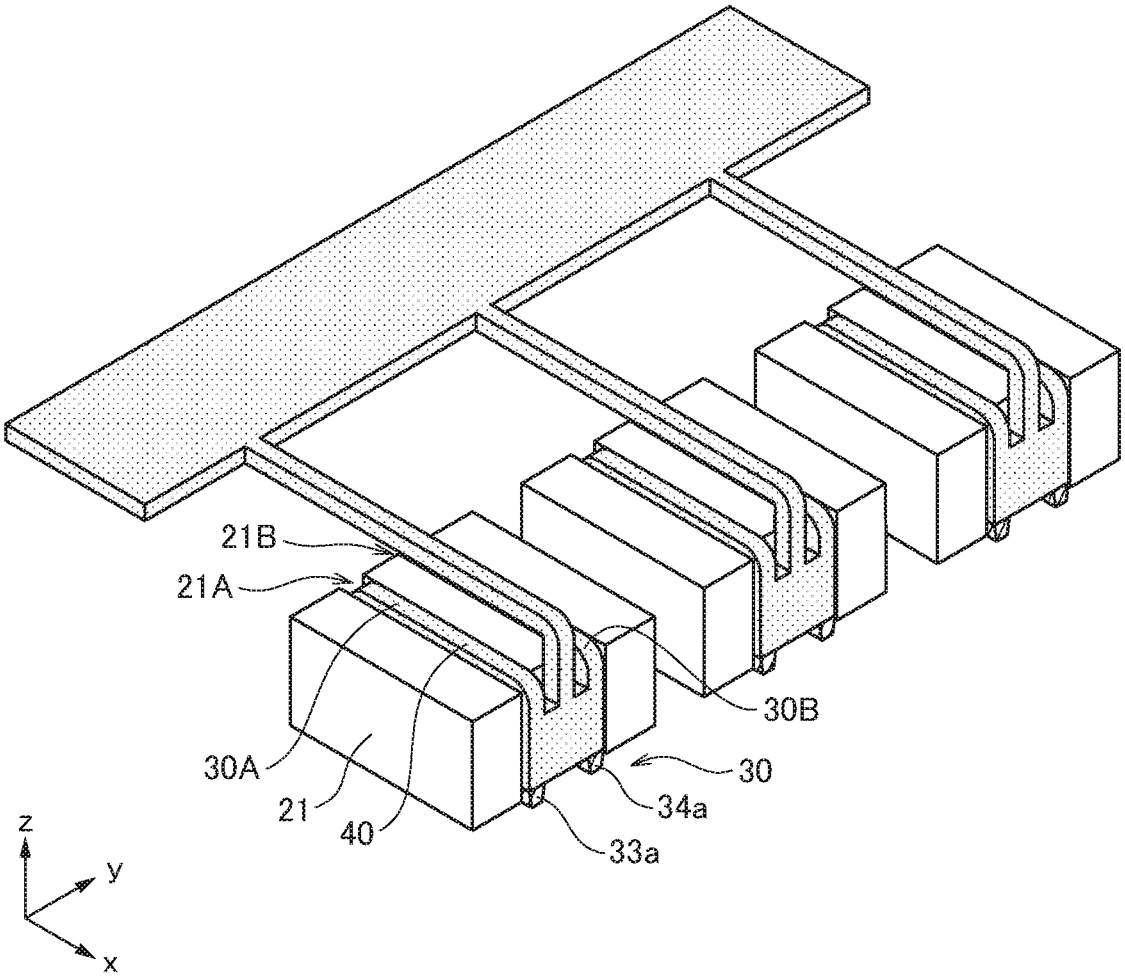
Figure 18:
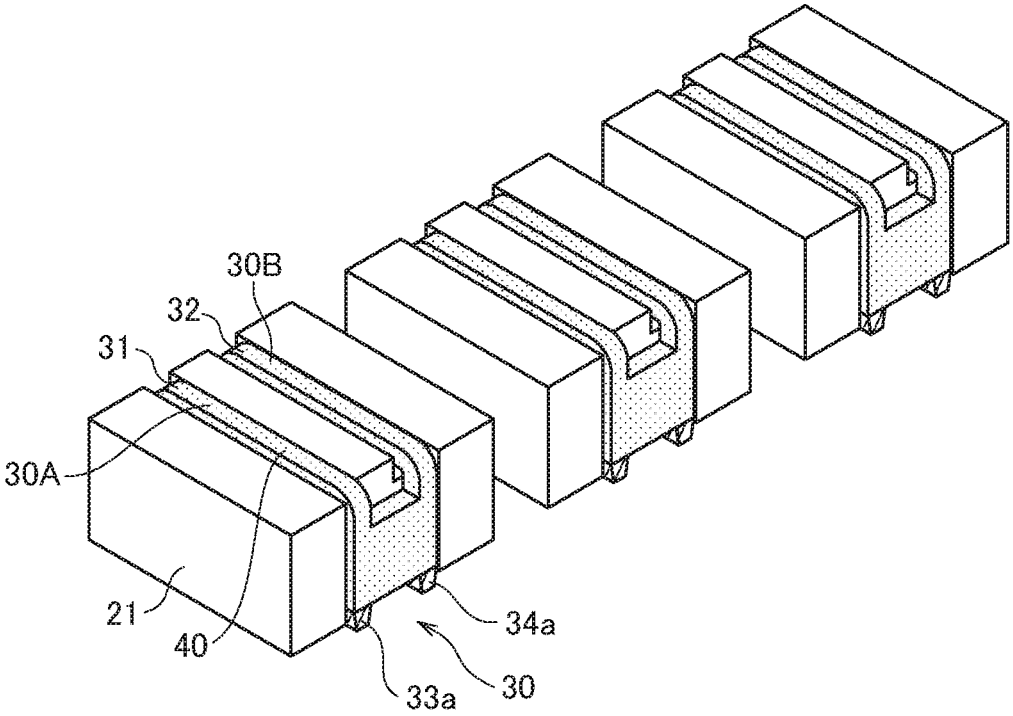
Figure 19:
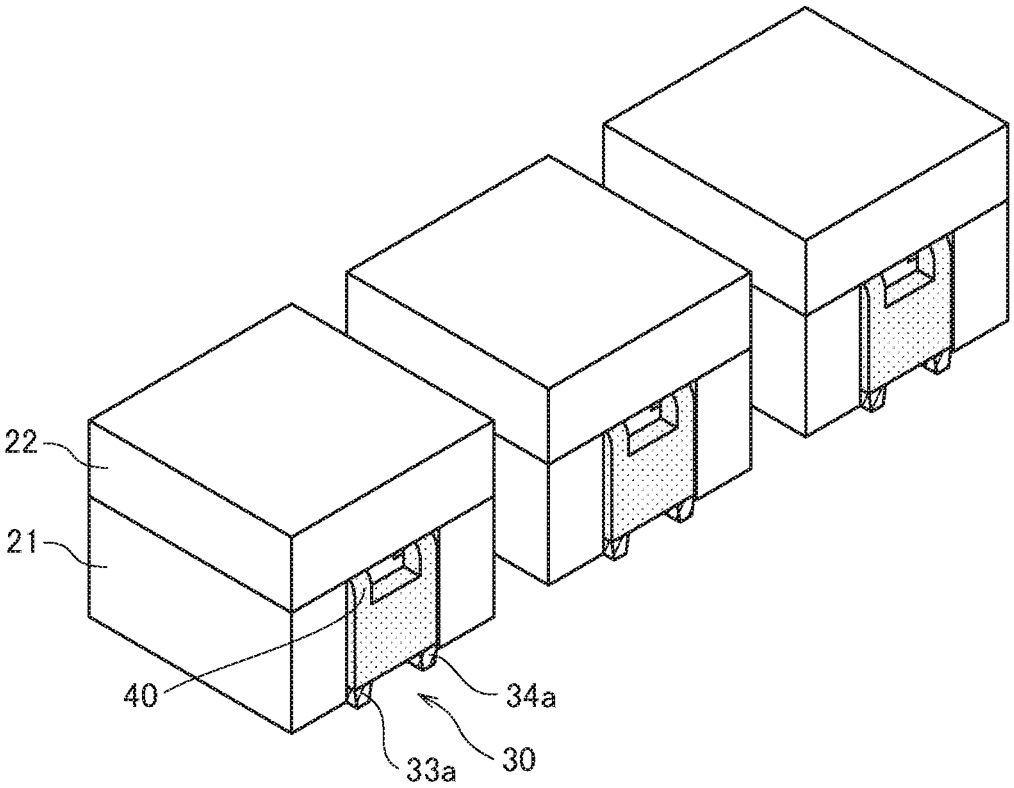

Subsequently, as illustrated in FIG. 17, the conductive plate 30 and the first core 21 are assembled to each other such that the first and second body parts 30A and 30B are housed in the grooves 21A and 21B, respectively. Then, as illustrated in FIG. 18, the connection part 35 and the support part 36 are separated from each other. Subsequently, as illustrated in FIG. 19, the second core 22 is bonded to the first core 21, whereby the coil component 10 according to the present embodiment is completed.

As described above, in the manufacturing process of the coil component 10, the metal coating films 31*a* to 34*a* are formed by plating after electrodeposition and partial removal of the insulating film 40, allowing the insulating film 40 and metal coating films 31*a* to 34*a* to be formed on mutually different surfaces of the metal element body 30S. Thus, the metal coating film is not interposed between the metal element body 30S and the insulating film 40, thereby preventing the insulating film 40 from being damaged or peeled off due to heat at reflow. In addition, the insulating film 40 functions as the plating mask, allowing the metal coating films 31*a* to 34*a* to be selectively formed by plating without an additional plating mask being formed.

Further, in the present embodiment, a part of each of the terminal parts 31 to 34 around the tip end has the tapered surfaces S2, so that irradiation of laser beam in the direction Z3 simultaneously removes the insulating film 40 formed on the tip surface S1 and tapered surfaces S2 of each of the terminal parts 31 to 34. This reduces the number of processes required for removing the insulating film 40, which in turn can reduce manufacturing cost.

Second Embodiment

Figure 20:
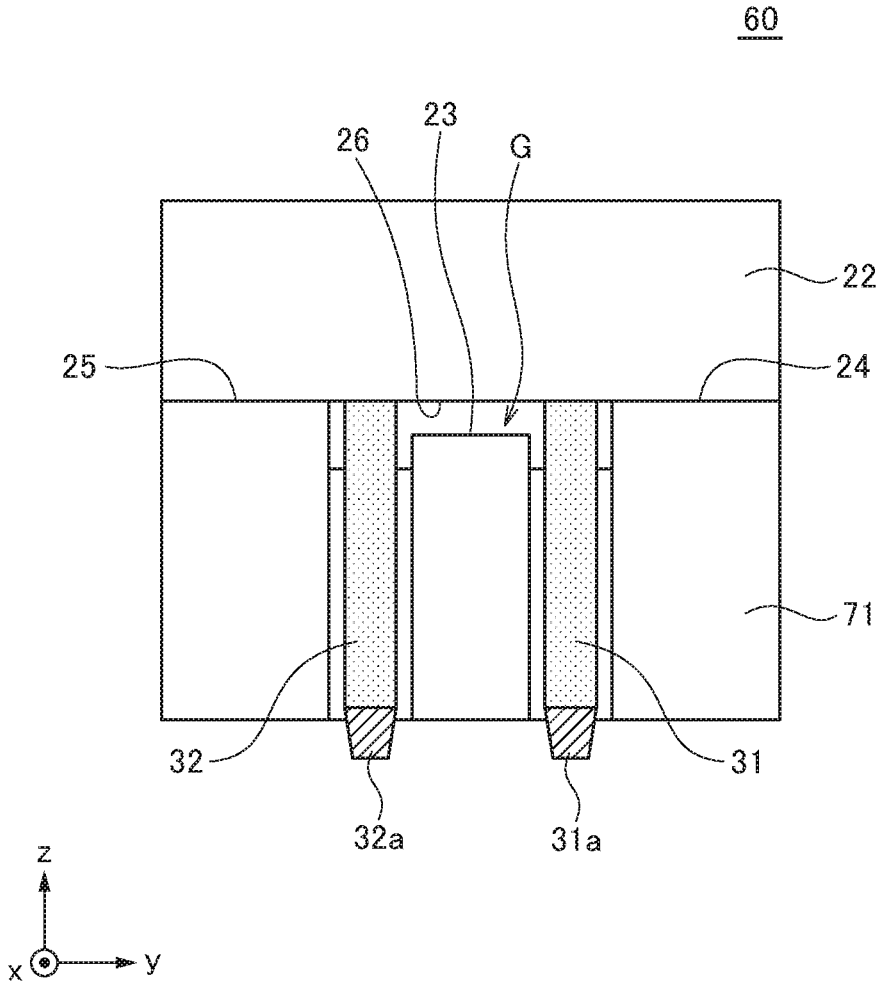
FIG. 20 is a side view for explaining the structure of a coil component according to a second embodiment of the present invention.

FIG. 20 is a side view for explaining the structure of a coil component 60 according to the second embodiment of the present invention.

As illustrated in FIG. 20, the coil component 60 according to the second embodiment differs from the coil component 10 according to the first embodiment in that a first core 71 is used in place of the first core 21. Other configurations are the same as those of the coil component 10 according to the first embodiment, so the same reference numerals are given to the same elements, and overlapping description will be omitted.

The first core 71 used in the present embodiment differs from the first core 21 used in the first embodiment in that the first upper surface part 23 is lower in height than the second and third upper surface parts 24 and 25. With this configuration, the magnetic gap G formed in the middle leg part is selectively increased, so that the amount of the magnetic fluxes ϕA1 and ϕB1 that pass through the middle leg part reduces further. Accordingly, the amount of the magnetic fluxes ϕA2 and ϕB2 that do not pass through the middle leg part increases, allowing the coupling coefficient to be increased to the negative side.

It is apparent that the present invention is not limited to the above embodiments, but may be modified and changed without departing from the scope and spirit of the invention.

For example, in the above-described manufacturing process, the insulating film 40 is partially removed (see FIG. 15) after being formed on the entire surface of the metal element body 30S (see FIG. 14). However, the present invention is not limited to this; the insulating film 40 may be subjected to electrodeposition with a predetermined portion of each of the first to fourth terminal parts 31 to 34 covered with a mask member. According to this method, while the process of masking the metal element body 30S is newly added, the process of partially removing the insulating film 40 can be omitted.

What is claimed is:

1. A coil component comprising:

a first magnetic core including:

an upper surface extending in a first direction and a second direction perpendicular to the first direction, wherein the upper surface includes first, second, and third upper surface parts;

first and second grooves formed on the upper surface, extending in the first direction and arranged in the second direction, wherein the first groove is positioned between the first and second upper surface parts in the second direction, and wherein the second groove is positioned between the first and third upper surface parts in the second direction;

a first side surface extending in the second direction and a third direction perpendicular to the first and second directions, wherein the first side surface includes first, second, and third side surface parts;

third and fourth grooves formed on the first side surface, extending in the third direction and arranged in the second direction, wherein the third groove is positioned between the first and second side surface parts in the second direction, and wherein the fourth groove is positioned between the first and third side surface parts in the second direction; and a second side surface extending in the second and third directions and positioned on an opposite side to the first side surface, wherein the second side surface includes fourth, fifth, and sixth side surface parts, wherein the fourth side surface part is positioned between the fifth and sixth side surface parts in the second direction, and wherein the fourth side surface part is recessed so as to form a fifth groove extending in the third direction and positioned between the fifth and sixth side surface parts in the second direction; and a conductive plate including:

first and second body parts inserted respectively into the first and second grooves;

a first terminal part inserted into the third groove and connected to one end of the first body part;

a second terminal part inserted into the fourth groove and connected to one end of the second body part; and a connection part inserted into the fifth groove and connected in common to other ends of the first and second body parts, wherein an area of each of the second and third upper surface parts is larger than that an entire area of the first upper surface part.

2. The coil component as claimed in claim 1, wherein the area of each of the second and third upper surface parts is more than one time and five times or less the area of the first upper surface part.

3. The coil component as claimed in claim 2, wherein the area of each of the second and third upper surface parts is more than one time and three times or less the area of the first upper surface part.

4. The coil component as claimed in claim 1, further comprising a second magnetic core having a flat lower surface, wherein the upper surface of the first magnetic core and the lower surface of the second magnetic core are bonded to each other to close upper portions of the respective first and second grooves to thereby form the first and second through holes.

5. The coil component as claimed in claim 4, wherein the first to third upper surface parts constitute the same plane.

6. The coil component as claimed in claim 4, wherein the first upper part is lower in height than each of the second and third upper surface parts to make a magnetic gap formed in the first upper surface part larger than a magnetic gap formed in each of the second and third upper surface parts.

7. The coil component as claimed in claim 1, wherein the conductive plate further includes third and fourth terminal parts protruding from the connection part.

8. The coil component as claimed in claim 7, wherein each of the first to fourth terminal parts has a tapered shape in which a sectional area thereof is gradually reduced toward a tip end thereof.

9. The coil component as claimed in claim 7, wherein the first to fourth terminals parts are covered with a metal coating film made of a material having a lower melting point than the First to fourth terminal parts, and wherein the first body part, second body part, and connection part are covered with an insulating firm.

10. The coil component as claimed in claim 1, wherein the first to third side surface parts constitute the same plane.

11. The coil component as claimed in claim 1, wherein the fifth and sixth side surface parts constitute the same plane.

12. The coil component as claimed in claim 1, wherein an area of each of the second and third side surface parts is larger than an area of the first side surface part.

13. The coil component as claimed in claim 1, wherein an area of the fourth side surface part is larger than an area of each of the fifth and sixth side surface parts.

14. A coil component comprising:

a magnetic core including:

an upper surface extending in a first direction and a second direction perpendicular to the first direction, wherein the upper surface includes first, second, and third upper surface parts;

first and second grooves formed on the upper surface, extending in the first direction and arranged in the second direction, wherein the first groove is positioned between the first and second upper surface parts in the second direction, and wherein the second groove is positioned between the first and third upper surface parts in the second direction;

a first side surface extending in the second direction and a third direction perpendicular to the first and second directions, wherein the first side surface includes first, second, and third side surface parts;

third and fourth grooves formed on the first side surface, extending in the third direction and arranged in the second direction, wherein the third groove is positioned between the first and second side surface parts in the second direction, and wherein the fourth groove is positioned between the first and third side surface parts in the second direction;

a second side surface extending in the second and third directions and positioned on an opposite side to the first side surface, wherein the second side surface includes fourth, fifth, and sixth side surface parts, wherein the fourth side surface part is positioned between the fifth and sixth side surface parts in the second direction, and wherein the fourth side surface part is recessed so as to form a fifth groove extending in the third direction and positioned between the fifth and sixth side surface parts in the second direction; and a bottom surface extending in the first and second directions and positioned on an opposite side to the upper surface; and a conductive plate including:

first, second, third, fourth, and fifth sections inserted respectively into the first, second, third, fourth, and fifth grooves, wherein the third section is connected to one end of the first section, wherein the fourth section is connected to one end of the second section, and wherein the fifth section is connected in common to other ends of the first and second sections; and first, second, third, and fourth terminal parts protruding from the bottom surface of the magnetic core, wherein the first terminal part is connected to the third section, wherein the second terminal part is connected to the fourth section, and wherein the third and fourth terminal parts are connected to the fifth section, wherein an area of each of the second and third upper surface parts is larger than an entire area of the first upper surface part.

15. The coil component as claimed in claim 14, wherein an area of each of the second and third upper surface parts is larger than an area of the first upper surface part.

16. The coil component as claimed in claim 14, wherein an area of each of the second and third side surface parts is larger than an area of the first side surface part.

17. The coil component as claimed in claim 14, wherein an area of the fourth side surface part is larger than an area of each of the fifth and sixth side surface parts.

18. A coil component comprising:

a magnetic core including:

an upper surface extending in a first direction and a second direction perpendicular to the first direction, wherein the upper surface includes first, second, and third upper surface parts;

first and second grooves formed on the upper surface, extending in the first direction and arranged in the second direction, wherein the first groove is positioned between the first and second upper surface parts in the second direction, wherein the second groove is positioned between the first and third upper surface parts in the second direction, and wherein the first and second grooves are formed independently from each other so as not to be connected to each other on the upper surface thereby the first upper surface is not divided into a plurality of surfaces;

a first side surface extending in the second direction and a third direction perpendicular to the first and second directions, wherein the first side surface includes first, second, and third side surface parts;

third and fourth grooves formed on the first side surface, extending in the third direction and arranged in the second direction, wherein the third groove is positioned between the first and second side surface parts in the second direction, and wherein the fourth groove is positioned between the first and third side surface parts in the second direction;

a second side surface extending in the second and third directions and positioned on an opposite side to the first side surface, wherein the second side surface includes fourth and fifth side surface parts; and a fifth groove formed on the second side surface, extending in the third direction and positioned between the fourth and fifth side surface parts in the second direction; and a conductive plate including first, second, third, fourth, and fifth sections inserted respectively into the first, second, third, fourth, and fifth grooves, wherein the third section is connected to one end of the first section, wherein the fourth section is connected to one end of the second section, and wherein the fifth section is connected in common to other ends of the first and second sections, wherein an area of each of the second and third upper surface parts is larger than an entire area of the first upper surface part.

19. The coil component as claimed in claim 18, wherein an area of each of the second and third side surface parts is larger than an area of the first side surface part.

* * * * *